US005332421A

United States Patent [19]

Stoughton, deceased

[11] Patent Number: 5,332,421

[45] Date of Patent: Jul. 26, 1994

[54] PROCESS FOR EXTRACTING ALUMINUM FROM ORE

[75] Inventor: William J Stoughton, deceased, late of Gooderham, Canada, by Clifford J. Stoughton, administrator

[73] Assignee: Clifford J. Stoughton, Gooderham, Canada

[21] Appl. No.: 15,589

[22] Filed: Feb. 10, 1993

[51] Int. Cl.[5] ..... C22B 21/02

[52] U.S. Cl. ..... 75/673

[58] Field of Search ..... 75/673, 674

[56] References Cited

U.S. PATENT DOCUMENTS

| | | |
|---|---|---|
| 146,330 | 1/1874 | Gallet . |
| 898,116 | 9/1908 | Kretschmer . |
| 937,387 | 10/1909 | Reid . |
| 958,700 | 5/1910 | Glass . |
| 1,028,046 | 5/1912 | Marsh . |
| 1,729,496 | 9/1929 | Simpson . |
| 1,945,260 | 1/1934 | Davies . |
| 2,139,065 | 12/1938 | Betterton et al. . |
| 2,279,565 | 4/1942 | Fletcher et al. . |
| 2,535,536 | 12/1950 | Hagmaler . |
| 2,654,670 | 10/1953 | Davis et al. . |
| 3,194,695 | 7/1965 | Yanagawa . |
| 3,871,875 | 3/1975 | Yokota . |
| 4,812,168 | 3/1989 | Cochran et al. ..... 75/674 |

*Primary Examiner*—Melvyn J. Andrews

*Attorney, Agent, or Firm*—Barry R. Lipsitz

[57] ABSTRACT

A method of smelting aluminum from aluminum ore wherein the powdered ore is mixed with a flux containing substantial amounts of borax, sodium bicarbonate and a copper compound, preferably copper sulphate. The mixture is placed in a suitable vessel, preferably with a rounded bottom, that can withstand high temperatures and that has an outlet hole in the bottom. The mixture of powdered ore and flux is heated to a temperature sufficient to melt the mixture and thereby produce a molten material containing aluminum. The molten material is allowed to flow out of the outlet hole and to cool outside by means of air cooling which results in the aluminum separating out. Preferably, the flux comprises about one third borax, one third sodium bicarbonate and about one third copper sulphate. A suitable ore for this method is nepheline syenite.

20 Claims, 1 Drawing Sheet

PROCESS FOR EXTRACTING ALUMINUM FROM ORE

BACKGROUND OF THE INVENTION

This invention relates to a method of smelting or producing aluminum from aluminum ore.

Methods are known for extracting aluminum from an aluminum bearing ore but there appears to be only one commercially used process, which process requires the use of large amounts of electricity. This method of production relies on the ore bauxite which contains about 50 to 65% alumina (aluminum oxide $AL_2O_3$). This ore is generally found in tropical climates as it is formed by the weathering of aluminum-rich rocks under tropical conditions. The aluminum is produced by separating pure alumina from bauxite in a refinery and then treating the alumina by electrolysis. An electric current flowing through a molten electrolyte, in which alumina has been dissolved, divides the aluminum oxide into oxygen and aluminum metal, which collects on the bottom of the carbon-lined cell (cathode).

The present invention provides a process for smelting aluminum from an aluminum ore, which process does not require the use of bauxite as the source of the aluminum in the process. Moreover, the process described herein does not require the use of electricity for an electrolysis process.

The method of smelting aluminum described herein is capable of producing aluminum from commonly occurring minerals and, in particular, from nepheline. It can be used, for example, to produce aluminum from nepheline syenite.

SUMMARY OF THE INVENTION

According to one aspect of the invention, a method of smelting aluminum from aluminum ore comprises providing aluminum containing ore in the form of a coarse powder and mixing this powdered ore with a flux containing substantial amounts of borax, sodiumbicarbonate, and a copper compound in a mixed state. The mixture of powdered ore and flux is placed in a suitable vessel capable of withstanding high temperatures and having an outlet hole in the bottom thereof. The mixture of powdered ore and flux is heated in the vessel to a temperature sufficient to melt the mixture of powdered ore and flux, thereby producing molten material containing aluminum. The molten material is permitted to flow out of the outlet hole and to cool outside of the vessel. The aluminum separates out as the molten material cools.

A preferred form of the flux contains about one third borax, about one third sodium bicarbonate and about one third copper compound. A suitable copper compound is copper sulphate or bluestone.

According to another aspect of the invention, a method of smelting aluminum from aluminum ore comprises heating a mixture of aluminum containing ore and a flux in a suitable vessel capable of withstanding high temperatures and having an outlet hole in a bottom thereof. The flux comprises borax, sodium bicarbonate and a copper compound in a mixed state. The mixture is heated sufficiently to melt the mixture of ore and flux and to produce a molten material containing aluminum. This material is permitted to flow out of the outlet hole and to cool outside of the vessel and the aluminum separates out as the molten material cools.

According to a further aspect of the invention, a method of smelting aluminum from an aluminosilicate ore comprises mixing molten aluminosilicate ore with a flux in a suitable crucible capable of withstanding the high temperature of molten rock. The flux comprises a mixture of borax, sodium bicarbonate and a copper compound. The molten mixture is permitted to flow out of the crucible and to cool, thereby causing the aluminum to separate out from the remaining slag material.

Various features and preferred aspects of the invention will become apparent from the following detailed description taken in conjunction with the single drawing.

DETAILED DESCRIPTION OF PREFERRED EMBODIMENT

Figure 1:
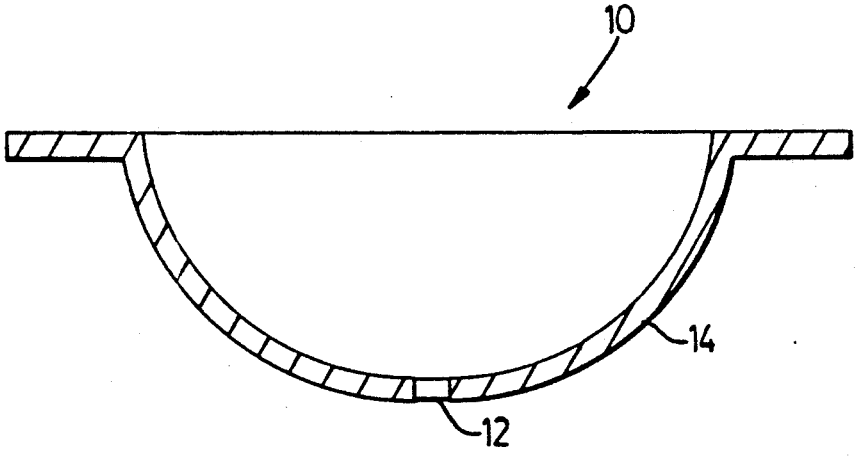
FIG. 1 is a cross-sectional view of a crucible suitable for suitable for carrying out the method of the invention, said cross-section being taken along a vertical plane through the center of the crucible.

The present method for smelting aluminum from aluminum ore is suitable for use with an aluminosilicate ore such as nepheline syenite. Nepheline, also known as nephelite, comprises $(Na,K)AlSiO_4$. It occurs chiefly in plutonic and volcanic rocks and in pegmatites associated with nepheline syenites. It is found in a number of locations in both Canada and the United States. The preferred initial state in the process of smelting aluminum from this ore is to reduce the ore to a coarse powder, preferably no coarser than coarse salt.

A flux is made for mixing with the powdered ore. This flux contains substantial amounts of borax, sodium carbonate and a copper compound which can be copper sulphate, also known as bluestone. These three ingredients are well mixed prior to mixing of the flux with the aluminum containing ore. A preferred form of the flux contains at least one third borax and at least one third sodium bicarbonate. Borax is a common term for sodium tetraborate ($Na_2B_4O_7$) and is known as a flux in other processes. A common term used for sodiumbicarbonate is baking soda. In a particularly preferred form of the flux, it comprises one third borax, one third sodiumbicarbonate and one third copper compound, preferably copper sulphate.

The powdered ore and the flux are mixed together either before or after they are placed in a suitable vessel capable of withstanding the high temperatures to which the contents of the vessel must be heated to render them molten. This vessel is preferably of the type shown in FIG. 1 of the drawings. The vessel 10 has an outlet hole 12 in its bottom. Preferably the bottom 14 of the vessel is rounded so that the bottom slopes towards the outlet hole 12 which is centrally located in the bottom. As illustrated, the vessel or crucible has an internal bottom surface of hemispherical shape. In a small version of this vessel employed by the inventor, the outlet hole measured $\frac{5}{8}$" in size.

The vessel can be heated using a coal fire, if desired, and preferably the fire is forced by blown air in order to heat the vessel to a sufficiently high temperature so that its contents are melted, thereby producing a molten material containing aluminum. This molten material is allowed to flow out of the outlet hole 12. It is cooled outside of the vessel and this cooling process can be assisted by blown air. The cooling of the material causes the aluminum to separate out.

There are several possible procedures for the heating step. For example, as the vessel is heated, some flux can be placed initially in the vessel and then layers of powdered ore and flux added to the contents of the vessel. As the contents become molten and the molten material flows out of the outlet hole 12, further amounts of powdered ore and flux can be added through the top of the vessel in a manner that permits them to mix.

An alternative procedure is to build up an adequate fire in the forge below a crucible which can be made of iron. The powdered ore, or even larger pieces of ore, can be placed in the crucible and heated until the ore becomes molten. The aforementioned flux can then be added to the molten ore in a manner permitting it to mix with the molten ore.

It will be appreciated that various modifications and changes could be made to the described process by one skilled in this art without departing from the spirit and scope of this invention. Accordingly, all such modifications and changes as fall within the scope of the appended claims are intended to be part of this invention.

I claim:

1. A method of smelting aluminum from aluminum ore comprising:

providing aluminum containing ore in the form of a coarse powder, mixing said powdered ore with a flux containing substantial amount of borax, sodium bicarbonate and a copper compound in a mixed state and placing the mixture of powdered ore and flux in a suitable vessel capable of withstanding high temperatures and having an outlet hole in a bottom thereof, heating said mixture of powdered ore and flux in said vessel to a temperature sufficient to melt said mixture of powdered ore and flux and thereby produce a molten material containing aluminum; and permitting said molten material to flow out of said outlet hole and to cool outside of said vessel, said aluminum separating out as said molten material cools.

2. A method of smelting aluminum according to claim 1 wherein said flux contains at least one third borax and at least one third sodium bicarbonate.

3. A method of smelting aluminum according to claim 1 wherein said flux contains about one third borax, about one third sodium bicarbonate and about one third copper compound.

4. A method of smelting aluminum according to claim 1 wherein said aluminum containing ore is an aluminosilicate.

5. A method of smelting aluminum according to claim 1 wherein said aluminum containing ore includes nepheline.

6. A method of smelting aluminum according to claim 1 wherein an inner surface of said vessel forms a hemispherical bottom.

7. A method of smelting aluminum according to claim 6 wherein said flux contains about one third borax, about one third sodiumbicarbonate and about one third copper sulphate.

8. A method of smelting aluminum according to claim 7 wherein said aluminum containing ore is an ore containing nepheline.

9. A method of smelting aluminum according to claim 7 wherein said mixture is heated by means of a coal fire in a forge, said fire being forced by blowing air into said forge.

10. A method of smelting aluminum from aluminum ore comprising heating a mixture of aluminum containing ore and a flux in a suitable vessel capable of withstanding high temperatures and having an outlet hole in a bottom thereof, said flux comprising borax, sodium bicarbonate and a copper compound in a mixed state, said mixture being heated sufficiently to melt said mixture of ore and flux and to produce a molten material containing aluminum and permitting said molten material to flow out of said outlet hole and to cool outside of said vessel, said aluminum separating out as said molten material cools.

11. A method of smelting aluminum according to claim 10 including the initial step of reducing said aluminum containing ore to a powder prior to mixing said ore with said flux.

12. A method of smelting aluminum according to claim 10 wherein said flux contains at least one third borax and at least one third sodium bicarbonate.

13. A method of smelting aluminum according to claim 10 wherein said flux contains at least one third borax and at least one thud sodium bicarbonate and said copper compound is copper sulphate.

14. A method of smelting aluminum according to claim 11 wherein said aluminum containing ore is nepheline syenite.

15. A method of smelting aluminum according to claim 11 wherein said vessel has a rounded bottom which slopes towards said outlet hole, said hole being centrally located in said bottom.

16. A method of smelting aluminum from aluminosilicate ore comprising:

mixing molten albinosilicate ore with a flux in a suitable crucible capable of withstanding the high temperature of molten rock, said flux comprising a mixture of borax, sodium bicarbonate and a copper compound, and permitting the molten mixture to flow out of said crucible and to cool, thereby causing said aluminum to separate out from the remaining slag material.

17. A method of smelting aluminum according to claim 16 wherein said flux contains about one third borax and about one third sodium bicarbonate.

18. A method of smelting aluminum according to claim 16 wherein said flux contains about one third borax, about one third sodium bicarbonate and about one third copper compound.

19. A method of smelting aluminum according to claim 18 wherein said crucible has an internal bottom surface of hemispherical shape and an outlet hole in the center of said bottom surface through which said molten mixture is permitted to flow.

20. A method of smelting aluminum according to claim 16 wherein said copper compound is copper sulphate.

* * * * *